US007252355B2

(12) United States Patent
Umeda

(10) Patent No.: US 7,252,355 B2
(45) Date of Patent: Aug. 7, 2007

(54) PRINT HEAD DRIVING CIRCUIT

(75) Inventor: Atsushi Umeda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 10/817,963

(22) Filed: Apr. 6, 2004

(65) Prior Publication Data

US 2005/0057588 A1 Mar. 17, 2005

(30) Foreign Application Priority Data

Apr. 7, 2003 (JP) ..... 2003-103356

(51) Int. Cl.
*B41J 29/38* (2006.01)

(52) U.S. Cl. ..... 347/10; 347/11; 347/12

(58) Field of Classification Search ..... 347/10, 347/11, 14, 211, 12
See application file for complete search history.

(56) References Cited

U.S. PATENT DOCUMENTS 6,068,360 A * 5/2000 Hiwada ..... 347/14

FOREIGN PATENT DOCUMENTS

JP 11-20203 A 1/1999

* cited by examiner

*Primary Examiner*—Lams S Nguyen
(74) *Attorney, Agent, or Firm*—Sughrue Mion, PLLC

(57) ABSTRACT

A print head driving circuit is provided whereby, even if the load changes, the accuracy of the driving voltage waveform supplied to the load can be maintained, and consequently, deterioration in printing quality can be prevented. Transistors Q3, Q4 connected in a push-pull configuration are connected to the upstream of a transistor Q1. If the base potential of the transistor Q1 rises above its normal level, then the emitter potential of the transistors Q3, Q4 will rise and the transistor Q3 will become non-conductive, and the transistor Q1 will also become non-conductive, but since the transistor Q4 is conductive, the current $I_2$ will flow from the base terminal of the transistor Q1, to earth, via the transistor Q4, and hence the base potential of the transistor Q1 will fall to or below the prescribed value. As a result, it is possible to prevent the base potential of the transistor Q1 from rising up in excess of the prescribed value.

7 Claims, 6 Drawing Sheets

PRINT HEAD DRIVING CIRCUIT

CROSS-REFERENCE TO PRIOR APPLICATION

This application relates to and claims priority from Japanese Patent Application No. 2003-103356 filed on Apr. 7, 2003, the entire disclosure of which is incorporated herein by reference.

BACKGROUND OF THE INVENTION

1. Field of the Invention

The present invention relates to a print head driving circuit for driving a print head having a plurality of nozzles.

2. Description of the Related Art

Conventionally, in an inkjet printer, a print head drive voltage waveform generating circuit and drive voltage waveform generating method have been proposed, with the object of obtaining a desired waveform, in a programmable fashion, by means of a simple operation. In these proposals, data for a plurality of points in a plurality of drive voltage waveforms at a prescribed temperature are previously stored as absolute coordinate data, and the data for a plurality of points in a desired drive voltage waveform are read out on the basis of tonal gradation data, and the data for this plurality of points is corrected on the basis of the difference between the ambient temperature during printing and the aforementioned prescribed temperature. Thereupon, the corrected absolute coordinate data is converted to relative coordinate data, and values between the points are interpolated, the interpolated drive voltage waveform data is converted to an analogue signal, and then amplified and output (see Japanese Patent Laid-open No. (Hei)11-20203, for example.)

In the conventional print head driving circuit 51 shown in FIG. 1, the voltage signal from the drive waveform generating circuit 53 is input to a current amplifying circuit 54 constituted by connecting an NPN type transistor 54*a* and a PNP type transistor 54*b* (hereinafter, both of these elements are called "transistor"), in a push-pull configuration. By amplifying the current of the aforementioned voltage signal, the voltage signal output from the current amplifying circuit 54 is supplied, as a nozzle driving voltage, to one electrode 52*a* of any one of the piezo elements provided respectively on each of the nozzles of the print head, via a switching circuit 55, which forms a transmission gate (for the sake of simplicity, only the piezo element labeled 52 is illustrated).

However, if the drive rate of any one of the aforementioned nozzles (piezo elements 52), which is the load of the current amplifying circuit 54 declines suddenly, for example, then a transient response will occur consequently in the operation of the transistor 54*a*. Therefore, cases may occur where the base voltage of the transistor 54*a* rises in excess of the prescribed value, giving rise to distortion in the nozzle drive voltage waveform output by the current amplifying circuit 54. In an inkjet printer provided with a print head driving circuit as illustrated in FIG. 1, if waveform distortion such as that described above occurs in the nozzle drive voltage, in other words, if the accuracy of the nozzle drive voltage waveform falls, then this risks causing a decline in printing quality. For example, if, in the middle of simultaneously performing printing using cyan ink and printing using magenta ink, for example, the printer changes suddenly from a state of solid printing of cyan ink to a state where no cyan ink is to be printed, then there is a risk that color fluctuation will occur in the printing using magenta ink.

SUMMARY OF THE INVENTION

Therefore, it is an object of the present invention to provide a print head driving circuit whereby, even if the load changes, the accuracy of the driving voltage waveform supplied to the load can be maintained, and consequently, decline in printing quality can be prevented.

The print head driving circuit according to a first aspect of the present invention is a circuit for driving a print head having a plurality of nozzles, comprising: a current amplifying section for outputting a drive signal of amplified current to a plurality of nozzle driving sections for driving the respective nozzles; wherein the current amplifying section comprises: a first stage current amplifying element that operates in accordance with a voltage signal input thereto; a second stage current amplifying element that changes the drive signal output to the respective nozzle driving sections, in accordance with an output signal input from the first stage current amplifying element; and an input potential restricting section, driven when the input potential to the second stage current amplifying element exceeds a prescribed value, for shorting out the input side of the second stage current amplifying element.

In a preferred embodiment of the first aspect of the present invention, the input potential restricting section shorts out the input terminal of the second stage current amplifying element, when the input potential of the second stage current amplifying element exceeds a prescribed value, during driving of the second stage current amplifying element.

In a further embodiment, the input potential restricting section is a switching section connected between the input terminal of the second stage current amplifying element and earth, the switching section being a semiconductor switching element which switches on and off in accordance with a control signal input thereto.

Moreover, in a further embodiment to the foregoing, the input potential restricting section shorts out the input terminal of the second current amplifying element, when the output potential of the second current amplifying element exceeds a prescribed value.

Moreover, in a further embodiment to the foregoing, each of the nozzle driving sections comprises a piezo element.

Moreover, in a further embodiment to the foregoing, the current amplifying section is contained in a drive voltage generating section for generating a voltage for driving the respective piezo elements.

Moreover, in a further embodiment to the foregoing, a trapezoidal waveform voltage output by the current amplifying section as a drive voltage for the respective piezo elements is transmitted to the respective piezo elements by passing through a drive voltage transmission path connected to the current amplifying section and the respective nozzle driving sections.

Moreover, in a further embodiment to the foregoing, the input potential restricting section shorts out the input terminal of the second current amplifying element, when the potential of the drive voltage transmission path exceeds the peak value of the trapezoidal waveform voltage.

Moreover, in a further embodiment to the foregoing, the second stage current amplifying element comprises an NPN type transistor forming a charging circuit for the respective piezo elements together with the drive voltage transmission path, and a PNP type transistor, connected to the NPN type transistor is a push-pull configuration, forming a discharging circuit for the respective piezo elements together with the drive voltage transmission path.

Moreover, in a further embodiment to the foregoing, the first stage current amplifying element comprises an NPN type transistor connected in a Darlington configuration to the second stage NPN type transistor, and a PNP type transistor, connected in a Darlington configuration to the second stage PNP type transistor and connected in a push-pull configuration to the first stage NPN type transistor.

Moreover, in a further embodiment to the foregoing, the input potential restricting section is a PNP type transistor connected between the input terminal of the first stage NPN type transistor and earth.

The print head driving circuit according to a second aspect of the present invention is a circuit for driving a print head, having a plurality of nozzles and a plurality of nozzle driving sections for driving the respective nozzles, comprising: a drive signal generating section for generating a drive signal for the respective nozzles; and a current amplifying section for amplifying the current of the drive signal from the drive signal generating section and outputting same to the respective nozzle driving sections; wherein the current amplifying section comprises: a pair of downstream side active power elements connected in a push-pull configuration wherein their polarities are mutually reserved, comprising a first active power element which is switched on by means of the value of the voltage signal input to same reaches or exceeds a prescribed value, and a second active power element of reverse polarity to the first active power element; and a pair of upstream active power elements connected in a push-pull configuration wherein their polarities are mutually opposite, comprising a third active power element of the same polarity as the first active power element, and a fourth active power element of the same polarity as the second active power element, the third active power element being connected to the first active power element in a Darlington configuration, and the fourth active power element being connected between the input terminal of the first active power element and earth, and the first active power element constituting a charging circuit to the respective nozzle driving sections, for connecting a power supply to the respective nozzle driving sections.

A preferred embodiment of the second aspect of the present invention further comprises: in addition to the pair of upstream active power elements, a further pair of upstream active power element connected in a push-pull configuration wherein their polarities are mutually opposite, comprising a fifth active power element of the same polarity as the first active power element, and a sixth active power element of the same polarity as the second active power element, the sixth active power element being connected to the second active power element in a Darlington configuration, and the sixth active power element being connected between the input terminal of the second active power element and earth.

DESCRIPTION OF THE PREFERRED EMBODIMENTS

Below, an embodiment of the present invention is described in detail with reference to the drawings.

Figure 2:
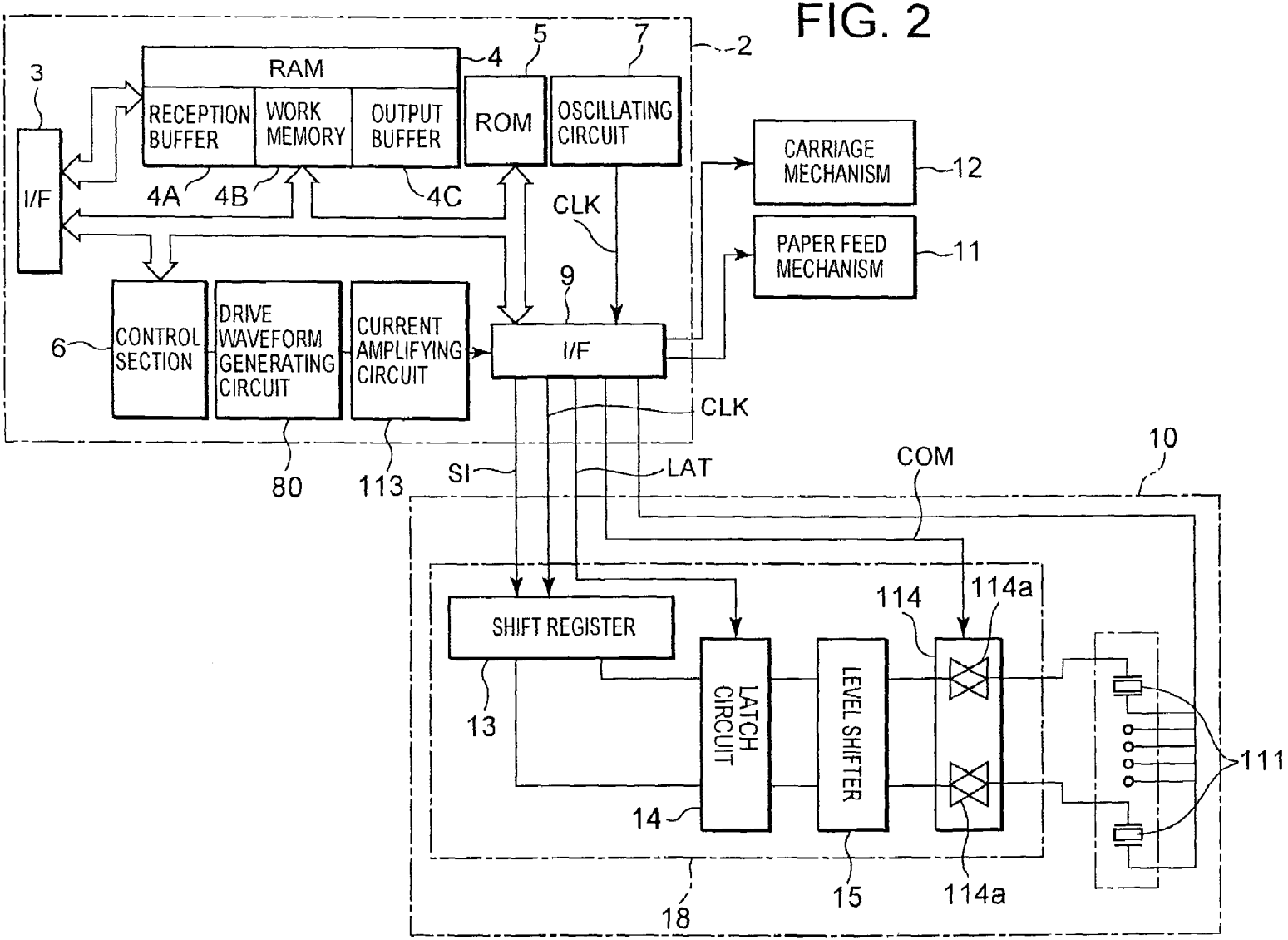
FIG. 2 is a functional block diagram showing the overall composition of an inkjet printer provided with a print head driving circuit relating to one embodiment of the present invention.

FIG. 2 is a functional block diagram showing the overall composition of an inkjet printer (hereinafter, called "printer") provided with a print head driving circuit relating to one embodiment of the present invention.

As shown in FIG. 2, the printer comprises a printer main body 2, a print head 10, a paper feed mechanism 11 and a carriage mechanism 12. The printer main body 2 comprises an interface (hereinafter, called "I/F") 3, a RAM 4, a ROM 5, a control section 6, an oscillating circuit 7, an interface (hereinafter called "I/F 9", similarly to the "I/F 3"), a drive waveform generating circuit 80, and a current amplifying circuit 113.

The print head 10 is connected to the printer main body 2 by means of a signal transmission cable, such as a flexible flat cable (FFC), for example, and it comprises a plurality of nozzle openings (for example, 96 nozzle openings) in the secondary scanning direction, ink drops being expelled from the respective nozzle openings at prescribed timings. The print head 10 comprises a head driving section 18, and a plurality of piezo elements 111 (in FIG. 2, only two are depicted, in order to simplify the description). The head driving section 18 comprises a shift register 13, a latch circuit 14, a level shifter 15, and a transmission gate, in other words, a switching circuit 114. The switching circuit 114 comprises a plurality of analogue switches 114*a* (in FIG. 2, only two are depicted, in order to simplify the description).

The paper feed mechanism 11 comprises a paper feed motor (not illustrated), a paper feed roller (not illustrated), and the like, and it performs secondary scanning by feeding the recording medium (not illustrated), such as printing paper, or the like, in a successive fashion. The carriage mechanism 12 comprises a carriage (not illustrated) for installing print head 10, a carriage motor (not illustrated) which causes this carriage (not illustrated) to travel by means of a timing belt (not illustrated), and the like, and it thereby causes the print head 10 to perform principal scanning.

In the printer main body 2, the I/F 3 receives various types of recording data, such as printing data containing multiple-value tone information transferred from a host device (not illustrated) such as a personal computer (hereinafter, referred to as "PC"), for example. The RAM 4 is a memory which inputs the various types of recording data received by the I/F 3 and stores this data, and it comprises a reception buffer 4A, a work memory 4B and an output buffer 4C. The reception buffer 4A inputs and holds the aforementioned various types of recording data received by the I/F 3. The various types of recording data held in the reception buffer 4A are read out by the control section 6, via a bus line provided inside the printer main body 2. The work memory 4B is a work area for temporarily stored work data of various types, and the like, and it is an area set within the storage region of the RAM 4. The output buffer 4C is established within the storage region of the RAM 4, as a region for expanding and storing the recording data read out and interpreted by the control section 6, from the aforementioned various types of recording data held in the reception buffer 4A, this data forming printing image data.

The ROM 5 stores a routine, or the like, whereby the control section 6 carries out data processing with respect to the aforementioned various types of recording data, for example. The oscillator circuit 7 generates a clock signal CLK of a prescribed cycle and outputs same to the I/F 9.

The control section 6 is constituted by a CPU, or the like, for example, and it reads out the various types of recording data from the reception buffer 4A, via the aforementioned bus line, interprets the commands therein, and executes processing for appending the print position of each text character, the type of ornamentation, the size of text, the font address, and the like. The control section 6 also expands the data from which commands have been interpreted, into the output buffer 4C, as printing image data, and this data is stored in the output buffer 4C. The control section 6 also outputs control signals to the drive waveform generating circuit 80.

The drive waveform generating circuit 80 is a head driver IC which, under the control of the control section 6, generates a voltage waveform (trapezoidal waveform) for driving the piezo elements 111, which form nozzle driving means, from the drive waveform signals, and outputs same to the current amplifying circuit 113. The current amplifying circuit 113 amplifies the current of the output signals from the drive waveform generating circuit 80, and outputs a COM signal, which is a drive signal for the piezo elements 111. This COM signal is supplied to one of the plurality of piezo elements 111, from the current amplifying circuit 113, via the I/F 9, and the switching circuit 114. The I/F 9 has a function for transmitting print data SI expanded into dot pattern data, for example, to the print head 10, and the like. When printing image data corresponding to one scan of the print head 10 has been obtained, the I/F 9 transfers this printer image data to the shift register 13 of the print head 10, in a serial fashion.

In the print head 10, the shift register 13 inputs the print data (SI/print head) expanded into printing image data which has been transferred in serial fashion from the I/F 9, in synchronism with the clock signal CLK output by the oscillating circuit 7 via the I/F 9, and outputs this data to the latch circuit 14. The latch circuit 14 temporarily latches the printing data (SI/print data) output by the shift register 13, in accordance with the latch signal LAT output from the I/F 9.

The level shifter 15 is a voltage amplifier, which raises the voltage of the aforementioned print data SI output by the latch circuit 14 to (a prescribed voltage of) approximately several 10 volts, which is a voltage capable of driving the respective analogue switches 114*a* of the switching circuit 114, and it outputs the amplified voltage to any one of the respective analogue switches 114*a*. The drive signal (COM signal) output to the switching circuit 114 by the current amplifying circuit 113, via the I/F 9, is applied to the piezo element 111 corresponding to the analogue switch 114*a* that has been switched on, and the ink inside the pressure generating chamber corresponding to that piezo element 111 is pressurized and expelled from the nozzle opening in the form of an ink drop.

Figure 3:
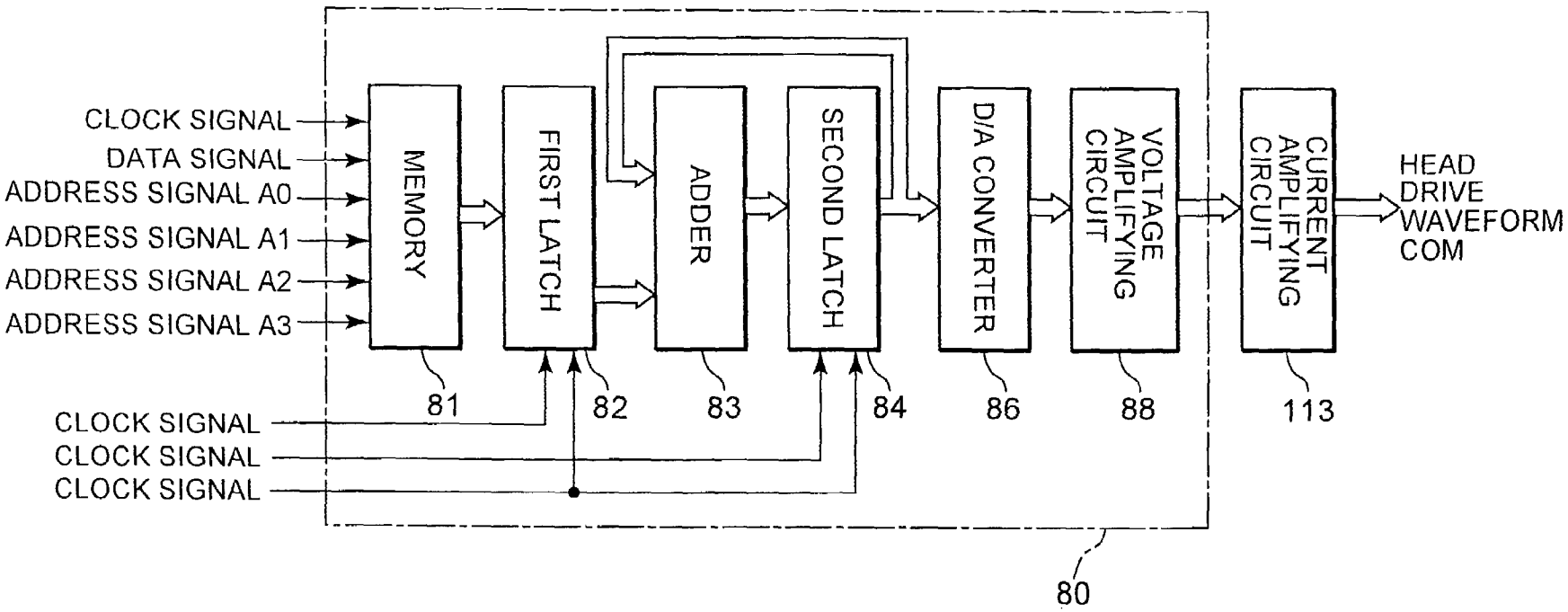
FIG. 3 is a functional block diagram showing the internal composition of a drive waveform generating circuit in the inkjet printer illustrated in FIG. 2.

FIG. 3 is a functional block diagram showing the internal composition of a drive waveform generating circuit in the inkjet printer illustrated in FIG. 2.

As FIG. 3 shows, the drive waveform generating circuit 80 comprises a memory 81, a first latch 82, an adder 83, a second latch 84, a D/A converter 86, and a voltage amplifying circuit 88. A memory 81 stores prescribed parameters that are required in order to determine the waveform of the drive signals for the piezo elements 111, and entries such as the block signal CLK, data signal, address signals (A0, A1, A2, A3), and the like, for example, are input to the memory 81. The memory 81 stores drive waveform data provided by the control section 6, or the like, illustrated in FIG. 2. The first latch 82 is a latch whose data latching operation is controlled by means of the clock signal CLK and a reset signal input to the latch, and it temporarily holds drive waveform data read out from the memory 81.

The adder 83 adds together the output from the first latch 82 and an output fed back from a second latch 84, and it supplies the result to the second latch 84. The second latch 84 is a latch whose data latching operation is controlled by means of the clock signal CLK and a reset signal input to the latch, and it temporarily holds data output by the adder 83. The D/A converter 86 converts the (digital) data output from the second latch 84 into analogue data (an analogue signal), which it outputs to a voltage amplifying circuit 88. The voltage amplifying circuit 88 amplifies the voltage of the analogue signal output by the D/A converter 86, by a prescribed amplification rate, and outputs the amplified voltage to the current amplifying circuit 113. The current amplifying circuit 113 amplifies the current of the output signal from the voltage driving circuit 88, by a prescribed amplification rate, and outputs the amplified signal to the switching circuit 114, as a drive signal (COM signal) for driving the piezo element 111. The waveform of the drive signal (COM signal) is determined by prescribed parameters received by the drive waveform generating circuit 80 from the control section 6, and the like.

As described with respect to FIG. 2, a switching circuit 114 provided with a plurality of analogue switches 114*a* is connected to the output side of the current amplifying circuit 113, via an I/F 9, and a corresponding piezo element 111 is connected respectively to each one of these analogue switches 114*a*. The ejecting face (not illustrated) of the print head 10 is formed with a plurality of nozzles (for example, 180 nozzles per row) which are positioned in 8 rows corresponding respectively to 8 colors of ink, such as C (Cyan), M (Magenta), Y (Yellow), K (Black), LC (Light Cyan), LM (Light Magenta), DY (Dark Yellow), or the like. By applying the aforementioned drive signal (COM signal) via an analogue switch 114*a* corresponding to a piezo element 111, for any one of the aforementioned piezo elements 111, the piezo element 111 is caused to vibrate, thereby pressurizing the ink inside the pressure generating chamber and causing ink drops to be expelled respectively from the plurality of nozzles.

Figure 4:
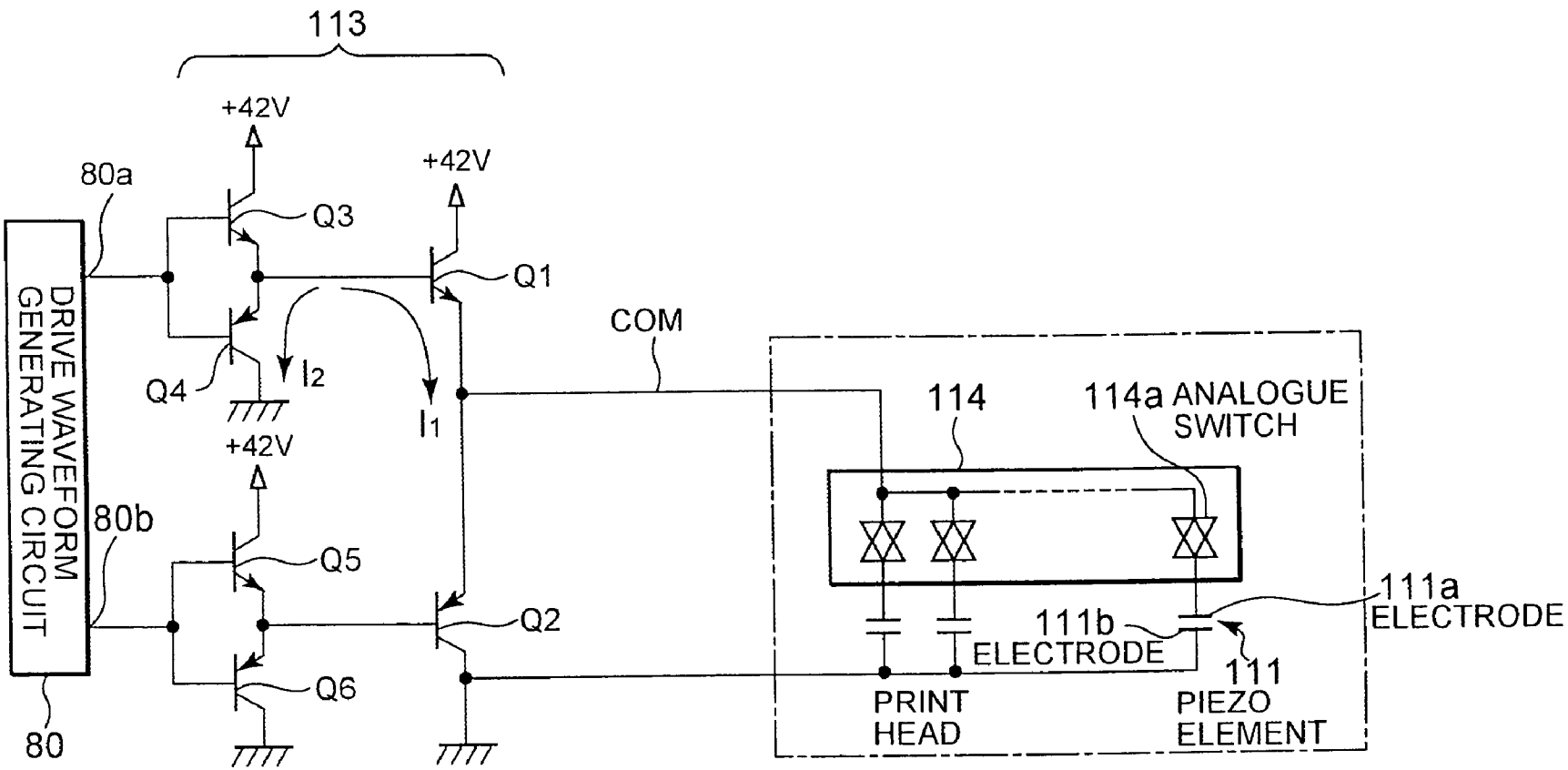
FIG. 4 is a diagram showing the circuit composition of the print head driving circuit relating to one embodiment of the present invention.

FIG. 4 is a diagram showing the circuit composition of the print head driving circuit relating to one embodiment of the present invention.

In FIG. 4, the current amplifying circuit 113 comprises NPN type transistors Q1, Q3, Q5 and PNP type transistors Q2, Q4, Q6. The transistors Q1, Q2 are connected in a push-pull configuration and respectively constitute a upstream (amplification stage) of the current amplifying circuit 113. The transistor Q1 constitutes a charging circuit for charging the drive voltage transmission path COM, and the respective analogue switches 114*a*, as well as the respective piezo elements 111, with a power supply voltage of 42V. The transistor Q2, on the other hand, constitutes a discharging circuit for discharging the charge accumulated in the drive voltage transmission path COM, and the respective analogue switches 114*a*, as well as the respective piezo elements 111.

The transistors Q3 and Q4 are connected in a push-pull configuration, similarly to the transistors Q1, Q2, and they constitute an upstream stage (amplification stage) in the current amplifying circuit 113, as viewed from transistor Q1. The base terminals of the transistors Q3, Q4 are both connected to the same output terminal 80*a* of the drive waveform generating circuit 80, and the emitter terminals of the transistors Q3, Q4 are both connected to the base terminal of the transistor Q1.

The transistors Q5 and Q6 are connected in a push-pull configuration, similarly to the transistors Q1, Q2 and transistors Q3, Q4, and they constitute an upstream stage (amplification stage) in the current amplifying circuit 113, as viewed from transistor Q2. The base terminals of the transistors Q5, Q6 are both connected to a further common output terminal 80*b* of the drive waveform generating circuit 80, separate to that described above, and the emitter terminals of the transistors Q5, Q6 are both connected to the base terminal of the transistor Q2.

The transistor Q3 which is the aforementioned upstream transistor and the transistor Q1 which is the aforementioned upstream transistor are connected in a Darlington configuration. Furthermore, the transistor Q5 which is the aforementioned upstream transistor and the transistor Q2 which is the aforementioned upstream transistor are also connected in a Darlington configuration.

At a stage prior to the transistor Q1 constituting the aforementioned charging circuit, the transistor Q3 switches on and off in accordance with the variation in the voltage signal applied to the base terminal of the transistor Q3 from the output terminal 80*a* of the drive waveform generating circuit 80. In other words, if the transistor Q3 assumes a switched on state due to the fact that the value of the voltage signal output by the aforementioned output terminal 80*a* has reached or exceeded a prescribed value, then a current $I_1$ flows from the 42V DC power supply, through the transistor Q3, to the base terminal of the transistor Q1. In this case, the transistor Q4 is in a switched off state.

Similarly to the transistor Q3, the transistor Q4 switches on and off in accordance with the variation in the voltage signal applied to the base terminal of the transistor Q4 from the output terminal 80*a* of the drive waveform generating circuit 80. In other words, if the transistor Q4 assumes a switched on state due to the fact that the value of the voltage signal output by the aforementioned output terminal 80*a* reaches or exceeds a prescribed value, then a current 12 flows from base terminal of the transistor Q1, through the transistor Q4, to earth. In this case, the transistor Q3 is in a switched off state.

At a stage prior to the transistor Q2 constituting the aforementioned discharging circuit, the transistor Q5 switches on and off in accordance with the variation in the voltage signal applied to the base terminal of the transistor Q5 from the output terminal 80*b* of the drive waveform generating circuit 80. More specifically, if the transistor Q5 assumes a switched on state due to the fact that the value of the voltage signal output by the aforementioned output terminal 80*b* reaches or exceeds a prescribed value, then power is supplied from the 42V DC power supply, via the transistor Q5, causing the electrical potential of the base terminal of the transistor Q2 to rise, and consequently, the transistor Q2 assumes a switched off state. In this case, the transistor Q6 is in a switched off state.

Similarly to the transistor Q5, the transistor Q6 switches on and off in accordance with the variation in the voltage signal applied to the base terminal of the transistor Q6 from the output terminal 80*b* of the drive waveform generating circuit 80. More specifically, if the transistor Q6 assumes a switched on state due to the fact that the value of the voltage signal output from the aforementioned output terminal 80*b* reaches or exceeds a prescribed value, then the transistor Q2 consequently assumes a switched on state, also. Therefore, the discharge current passing from any one of the piezo elements 111, and through the analogue switch 114*a* corresponding to that piezo element 111, the drive voltage transmission path COM and the transistor Q2, flows to earth, via the transistor Q6. In this case, the transistor Q5 is in a switched off state.

Here, it is supposed that, since the value of the voltage signal output by the drive waveform generating circuit 80 respectively via the output terminals 80*a* and 80*b* reaches or exceeds a prescribed value, the transistor Q1 assumes a switched on state, the transistor Q2 assumes a switched off state, and any one of the piezo elements 111 is charged by the 42 V DC power supply via the drive voltage transmission path COM and any one of the analogue switches 114*a*, in which case the base potential of the transistor Q1 is raised above a prescribed value. Thereby, the potential of the emitters of the transistors Q3, Q4 also rises. As a result, if the $V_{bg}$ of transistor Q3 becomes less than 0.6 V, then even if the value of the voltage signal applied to the base terminal of the transistor Q3 reaches or exceeds the prescribed value as described above, the transistor Q3 will assume a switched off state, and therefore, the transistor Q1 will also assume a switched off state, whereby the charging operation from the 42V DC power supply to the piezo element 111 will be shut off.

On the other hand, if the $V_{eb}$ of the transistor Q4 exceeds 0.6V, then even if the value of the voltage signal applied to the base terminal of the transistor Q3 reaches or exceeds the prescribed value as described above, the transistor Q4 will assume a switched on state, and therefore, the current $I_2$ will flow from the base terminal of the transistor Q1, through the transistor Q4, to earth. This flow of the current $I_2$ to earth causes the base potential of the transistor Q1 to decline gradually, and hence the potential at the emitters of the transistors Q3 and Q4 also declines, in a similar fashion. Therefore, when the base potential of the transistor Q1 reaches or falls below a prescribed value, the emitter potential of the transistor Q4 falls, the $V_{eb}$ of the transistor Q4 falls below 0.6 V, and therefore the transistor Q4 assumes a switched off state again. Conversely, within the fall of the emitter potential in the transistor Q3, the $V_{be}$ in the transistor Q3 rises above 0.6 V, and therefore the transistor Q3 assumes a switched on state again, thereby causing the transistor Q1 also to assume a switched on state again, and consequently the charging operation from the 42V DC power supply to the piezo element 111, via the transistor Q1, is restarted.

By inputting control signals (print data SI), the respective analogue switches 114*a* are switched on at the drive timing of the corresponding piezo element 111, and output a drive signal (COM signal) to the piezo element 111. Each piezo element 111 is composed in such a manner that it is displaced in accordance with the voltage applied between respective electrodes 111*a*, 111*b*. The electric potential of the piezo element 111 is constantly charged in such a manner that it assumes an approximately intermediate potential of the drive voltage waveform applied by the current amplifying circuit 113. If the charge accumulated in the piezo element 111 is discharged by the aforementioned discharging circuit, on the basis of a drive signal (COM signal) output by the drive waveform generating circuit 80, via the current amplifying circuit 113, then the piezo element 111 applies pressure to the ink in the corresponding nozzle, and hence an ink drop is expelled from the nozzle.

Figure 5:
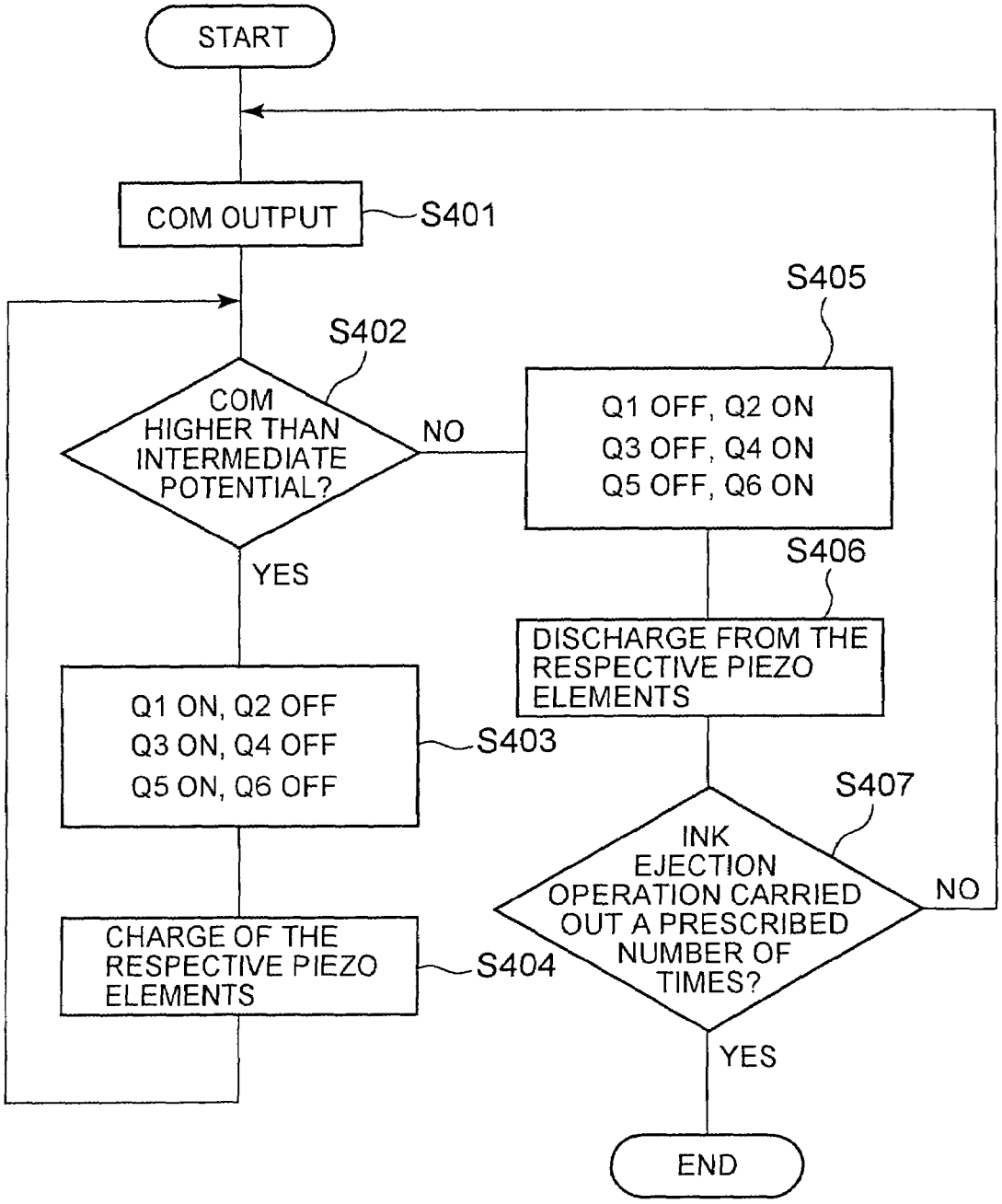
FIG. 5 is a flowchart showing the operation of an ink-jet printer provided with a print head driving circuit as illustrated in FIG. 4.

FIG. 5 is a flowchart showing the operation of an ink-jet printer provided with a print head driving circuit as illustrated in FIG. 4.

In FIG. 5, firstly, when the printer starts a printing operation, the control section 6 illustrated in FIG. 2, for example, reads in a drive signal (COM signal) output by the current amplifying circuit 113 (step S401), and checks whether or not the drive signal (COM signal) is higher than a prescribed intermediate electric potential (the intermediate potential of the drive voltage waveform applied by the current amplifying circuit 113) (step S402). If, as a result of this check, the drive signal (COM signal) is judged to be higher than the intermediate electric potential (YES at step S402), then the control section 6 activates the transistor Q3 and the transistor Q5, which are the upstream transistors described above, by means of the drive waveform generating circuit 80.

By this means, the upstream transistor Q1 forming the aforementioned charging circuit is activated. On the other hand, the transistor Q4 and the transistor Q6, which are upstream transistors, and the transistor Q2, which is a upstream transistor forming the aforementioned discharging circuit, assume a non-activated state (step S403). Consequently, charging of the respective piezo elements 111 is performed from the 42V DC power supply, via the aforementioned charging circuit, (step S404), and the procedure returns to the operation described in step S402.

On the other hand, if, as a result of the check, the drive signal (COM signal) is judged not to be higher than the intermediate electric potential (NO at step S402), then the control section 6 activates the transistor Q4 and the transistor Q6, by means of the drive waveform generating circuit 80. By this means, the upstream transistor Q2 forming the aforementioned discharging circuit is activated. On the other hand, the transistor Q3, the transistor Q5 and the transistor Q1 assume a non-activated state (step S405). Consequently, the charge accumulated in any of the piezo elements 111 is discharged via the transistor Q2 forming the discharging circuit, to earth (step S406).

In this way, the piezo element 111 is operated on the basis of the drive signal (COM signal) and an ink drop is expelled from the nozzle provided at the piezo element 111 in question. Thereupon, it is checked whether or not the operation of expelling ink drops from the nozzle be carried out a prescribed number of times (step S407). If, as a result of this check, it is judged that the operation of expelling ink drops reaches a prescribed number of times (NO at step S407), then the sequence returns to the operation indicated in step S401. On the other hand, if, as a result of this check, it is judged that the number of ink drop expulsion operations reaches a prescribed number of times (YES at step S407), then the printing operation is terminated.

Incidentally, the base potential of the transistor Q1 (constituting the upstream of the current amplifying circuit 113) is either the electric potential of the drive signal (COM signal), or a potential approximately 0.6 V greater than this potential. When the aforementioned voltage is applied to the base terminal of the transistor Q1, the transistor Q1 switches on, and a current $I_1$ flows as illustrated in FIG. 4, whereby the drive signal (COM signal) from the current amplifying circuit 113 is applied to the piezo element 111, via the switching circuit 114.

However, if the drive rate of each of the aforementioned nozzles (piezo elements 111), which is the load of the current amplifying circuit 113 declines suddenly, for example, then a transient response will occur consequently in the operation of the transistor Q1. Therefore, cases may occur where the base voltage of the transistor Q1 is raised in excess of the prescribed value, giving rise to distortion in the nozzle drive waveform (drive signal) (COM signal) output by the current amplifying circuit 113.

Therefore, in the present embodiment, as shown in FIG. 4, the transistor Q3, which is an NPN type transistor, and the transistor Q4, which is a PNP type transistor, connected together in a push-pull configuration, are connected in front of the transistor Q1. By this means, if the base potential of the transistor Q1 rises above its normal level, then as described above, the emitter potential of the transistors Q3, Q4 will rise and the transistor Q3 will switch off, and the transistor Q1 will also switch off, but since the transistor Q4 is switched on, the current $I_2$ will flow from the base terminal of the transistor Q1, to earth, via the transistor Q4, and hence the base potential of the transistor Q1 will fall to or below the prescribed value. As a result, it is possible to prevent the base potential of the transistor Q1 from rising up in excess of the prescribed value.

Figure 1:
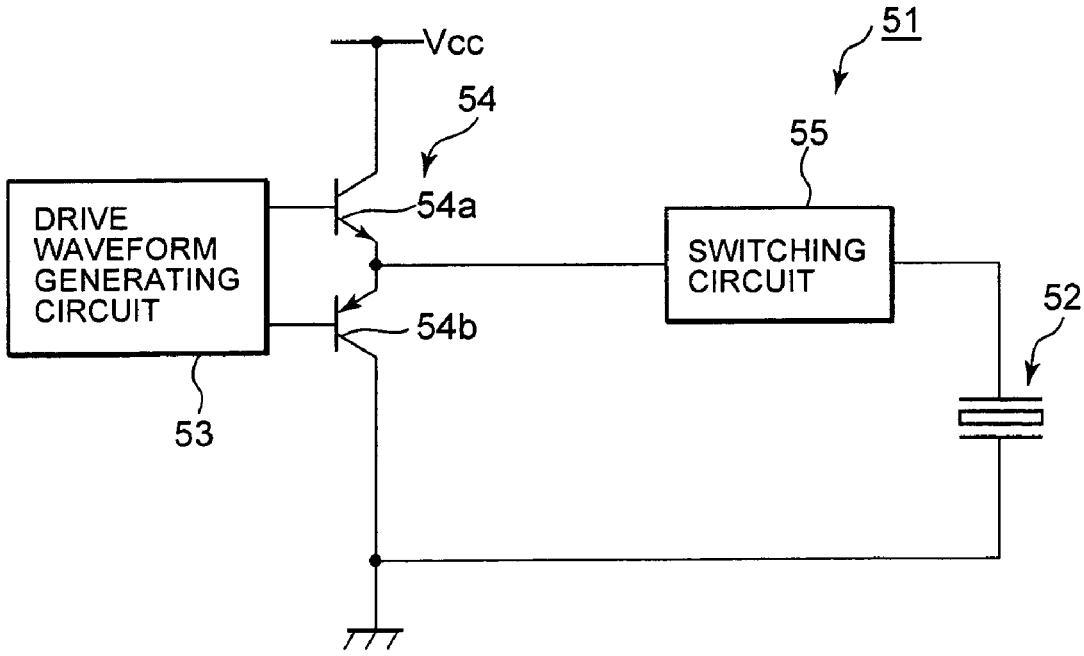
FIG. 1 (PRIOR ART)
FIG. 1 is a diagram showing the circuit composition of a conventional print head driving circuit.
Figure 6:
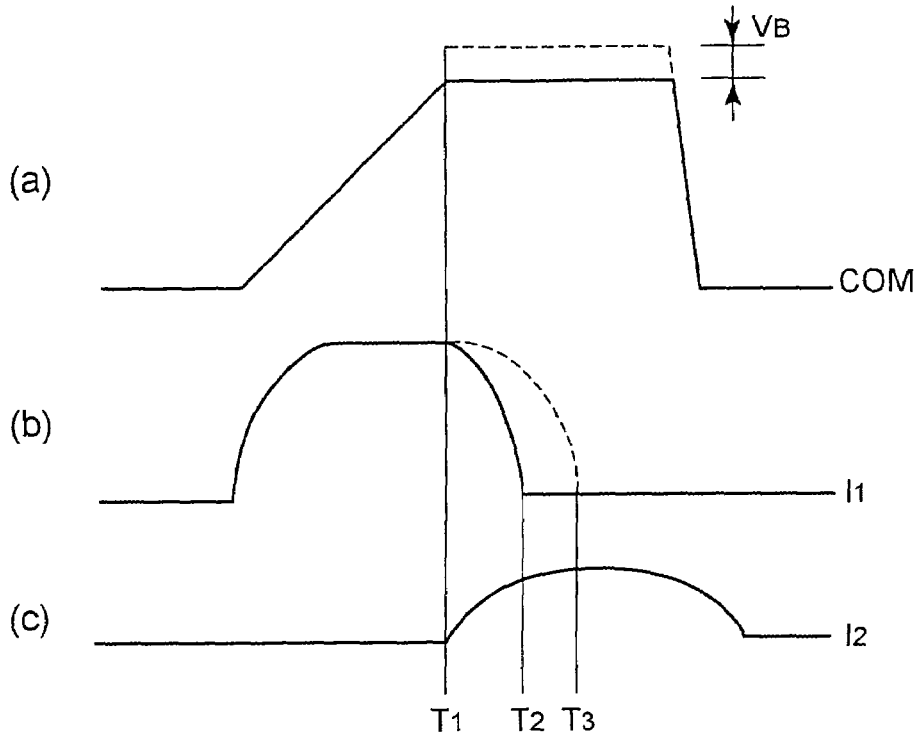
FIG. 6 shows a comparison between the transition in the base potential an NPN type transistor in the upstream of the current amplifying circuit shown in FIG. 4, and the transition in the base potential of an NPN type transistor of a conventional current amplifying circuit, as illustrated in FIG. 1.

FIG. 6 shows a comparison between the transition in the base potential in the transistor Q1 which is the upstream of the current amplifying circuit 113 shown in FIG. 4, and the transition in the base potential in a transistor 54*a* of a conventional current amplifying circuit, as illustrated in FIG. 1.

In FIG. 6, diagram (a) shows the base potential in the transistor Q1, diagram (b) shows the current $I_1$ and diagram (c) shows the current $I_2$. For example, if there is a sudden change in the state of the load on the current amplifying circuit 113, as described above, at time $T_1$, (if there is a sudden fall in the drive rate of the piezo element 111, or the like), then, as indicated by the broken line in FIG. 6(*a*), there may be cases where the base potential of the transistor Q1 consequently rises by an amount $V_B$ above the normal value marked by the solid line. In this state, as shown by the broken line in FIG. 6(*b*), the current $I_1$ continues to flow in the time band between time $T_2$ and time $T_3$, during which no current is originally supposed to flow, and hence distortion occurs in the drive waveform (drive signal) (COM signal) for the nozzle (piezo element) output by the current amplifying circuit 113.

However, in the present embodiment, if the base potential of the transistor Q1 rises above its normal value, then the transistors Q1 and Q3 are consequently switched off, whist the transistor Q4 is switched on, whereby the current $I_2$ having the waveform illustrated in FIG. 6(*c*) flows from the base terminal of the transistor Q1, to earth. Therefore, not only is it possible to prevent increase in the base potential of the transistor Q1, but furthermore, it is also possible to prevent the current $I_1$ from flowing in a time band in which it is not originally supposed to flow, and to prevent distortion from occurring in the drive waveform (drive signal) (COM signal) of the nozzle (piezo element 111) output by the current amplifying circuit 113.

Figure 7:
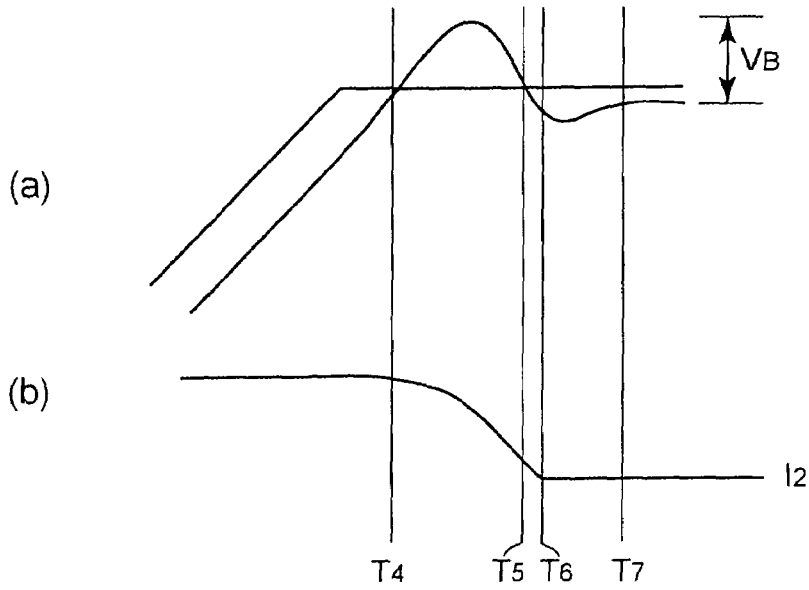
FIG. 7 shows a comparison between the transition in the base potential an NPN type transistor in the upstream of the current amplifying circuit shown in FIG. 4, and the transition in the base potential of an NPN type transistor of a conventional current amplifying circuit, as illustrated in FIG. 1.

FIG. 7 shows a comparison between the transition in the base potential in the NPN type transistor Q1 which is the upstream of the current amplifying circuit 113 shown in FIG. 4, and the transition in the base potential in an NPN type transistor 54*a* of a conventional current amplifying circuit, as illustrated in FIG. 1.

When there is a sudden change in the state of the load on the current amplifying circuit 113, as described above, consequently, the base potential of the transistor Q1 actually rises, in the form of an overshoot, as illustrated in FIG. 7(*a*). In this case, since the aforementioned current $I_2$ flows at the timing illustrated in FIG. 7(*b*) (time $T_6$), then after the base potential of the transistor Q1 has performed an overshoot at time $T_4$, as illustrated in FIG. 7(*a*), it performs a slight undershoot at time $T_5$, and then stabilizes at time $T_7$. In FIG. 7, the potential difference $V_B$ indicates the differential between the peak value of the base potential of the transistor Q1 when it overshoots, and its normal value.

A preferred embodiment of the present invention was described above, but this is an example for the purpose of describing the present invention, and the scope of the present invention is not limited to this embodiment alone. The present invention may be implemented in various further modes.

What is claimed is:

1. A driving circuit for a print head having a plurality of nozzles, said print head driving circuit comprising:

a current amplifying section for outputting a drive signal of an amplified current to a plurality of nozzle driving sections for driving said respective nozzles; and a voltage signal generating section which generates a voltage signal for controlling driving of the current amplifying section, converts digital data, which is a parameter for determining a waveform of a voltage signal, to analog data, generates a voltage signal on the basis of the analog data, and outputs the voltage signal to the current amplifying section, said current amplifying section comprising:

a first stage current amplifying element that operates in accordance with a voltage signal input thereto;

a second stage current amplifying element that changes said drive signal output to said respective nozzle driving sections, in accordance with an output signal from said first stage current amplifying element; and an input potential restricting section, driven when the input potential to said second stage current amplifying element exceeds a prescribed value, for shorting out the input side of said second stage current amplifying element until the input potential falls to or below a prescribed value, the second-stage current amplifying element comprising:

an NPN-type transistor which constitutes a drive voltage transmission path that connects the current amplifying section with the respective nozzle driving sections, and a charging circuit for piezo elements included in the respective nozzle driving sections; and a PNP-type transistor which is connected in a push-pull configuration to the NPN-type transistor, and which constitutes the drive voltage transmission path and a discharging circuit for the respective piezo elements, the first-stage current amplifying element comprising:

an NPN-type transistor which is connected in a Darlington configuration to the second-stage NPN-type transistor; and a PNP-type transistor which is connected in a Darlington configuration to the second-stage NPN-type transistor, and which is connected in a push-pull configuration to the first-stage NPN-type transistor, an emitter terminal of the first-stage NPN-type transistor being directly connected to an emitter terminal of the first-stage PNP-type transistor and a base terminal of the second-stage NPN-type transistor, and the voltage signal being output to the base terminal of the first-stage NPN-type transistor and the base terminal of the first-stage PNP-type transistor.

2. The print head driving circuit according to claim 1, wherein said input potential restricting section shorts out the input terminal of said second stage current amplifying element, when the input potential of said second stage current amplifying element exceeds a prescribed value, during driving of said second stage current amplifying element.

3. The print head driving circuit according to claim 2, wherein said input potential restricting section is a switching section connected between the input terminal of said second stage current amplifying element and earth, said switching section being a semiconductor switching element which switches on and off in accordance with a control signal input thereto.

4. The print head driving circuit according to claim 1, wherein said input potential restricting section shorts out the input terminal of said second current amplifying element, when the output potential of said second current amplifying element exceeds a prescribed value.

5. The print head driving circuit according to claim 1, wherein a trapezoidal waveform voltage output by the current amplifying section as a drive voltage for the respective piezo elements is transmitted to the respective piezo elements by passing through the drive voltage transmission path.

6. The print head driving circuit according to claim 1 or claim 5, wherein the input potential restricting section shorts out the input terminal of the second current amplifying elements, when the potential of the drive voltage transmission path exceeds a peak value of the trapezoidal waveform voltage.

7. The print head driving circuit according to claim 1, wherein the input potential restricting section is a PNP-typed transistor connected between the input terminal of the first-stage NPN-type transistor and earth.

* * * * *